United States Patent [19]

Walsh

[11] Patent Number: 4,834,369

[45] Date of Patent: May 30, 1989

[54] BASKETBALL BACKBOARD AND RIM ASSEMBLY

[76] Inventor: Timothy E. Walsh, 339 Library Dr., Slippery Rock, Pa. 16057

[21] Appl. No.: 215,217

[22] Filed: Jul. 5, 1988

[51] Int. Cl.[4] ..... A63B 63/08

[52] U.S. Cl. ..... 273/1.5 R; 248/598

[58] Field of Search ..... 273/1.5 R, 5 A; 172/264–269, 705; 49/386; 248/598, 596, 599, 634, 635, 573, 574; 272/136

[56] References Cited

U.S. PATENT DOCUMENTS

| | | | |
|---|---|---|---|
| 208,014 | 9/1878 | Galloway et al. | 172/264 |
| 597,686 | 1/1898 | Milner | 248/573 X |
| 2,517,463 | 8/1950 | Cobb | 273/1.5 R |
| 2,855,836 | 10/1958 | Sutherland | 172/705 |
| 3,814,359 | 6/1974 | Powell | 273/1.5 A X |
| 4,365,802 | 12/1982 | Ehrat | 273/1.5 R |
| 4,492,375 | 1/1985 | Connelly | 272/136 X |
| 4,583,732 | 4/1986 | Allen | 273/1.5 R |
| 4,747,597 | 5/1988 | Kluczny | 273/1.5 R |

FOREIGN PATENT DOCUMENTS

| | | | |
|---|---|---|---|
| 1313021 | 11/1962 | France | 273/1.5 R |
| 2551241 | 3/1985 | France | 273/1.5 R |
| 2572945 | 5/1986 | France | 273/1.5 R |
| 2069301 | 8/1981 | United Kingdom | 172/705 |

*Primary Examiner*—Paul E. Shapiro

*Attorney, Agent, or Firm*—Buchanan Ingersoll

[57] ABSTRACT

A backboard and rim assembly is provided for use with a sponge basketball. A basketball rim is secured to a base member which is pivotably attached to a basketball backboard. The rim is attached in such a manner that it may swing between a downward position parallel to the plane of the backboard and an upright position perpendicular to the plane of the backboard. A base member is pivoted at its lower end to the backboard and is connected at its upper end to the rim. A stop block is positioned between the backboard and rim to limit upward swinging of the rim. A hook extends from each side of the stop block. A rubber band is attached at each end to one of the hooks and is positioned to underly the base member thus biasing the rim upwardly against the stop block. When a downward force is applied to the rim, the rubber band stretches to permit the rim to swing downward toward the parallel position. When the force is removed, the rim will recoil and return to its perpendicular position.

6 Claims, 2 Drawing Sheets

BASKETBALL BACKBOARD AND RIM ASSEMBLY

BACKGROUND OF THE INVENTION

1. Field of the Invention

This invention relates to a backboard and rim assembly for use with a sponge basketball. More particularly, the present invention relates to a backboard and rim assembly having a collapsible rim.

2. Description of the Prior Art

For years, the game of basketball has been played either outdoors in the open or in a gymnasium. The rough nature of the sport and the bouncing and rebounding basketball have prevented the game from being played inside a house. However, with the advent of special foam and sponge materials which are soft enough not to damage the inside of a house, the game of basketball has been brought inside the house. In fact, groups have been formed which are devoted to the promotion of indoor sponge basketball.

To bring the game of basketball indoors, changes had to be made to the size of the ball. Consequently, special backboards and rims were developed to accommodate the smaller ball. Typically, such miniaturized rims are formed of plastic and fail to provide the look and feel of a real basketball game. The rims look cheap and are easily broken. Furthermore, a sponge basketball does not respond to the rim in a manner similar to that of a regulation basketball and rim.

In addition to the plastic rims, some miniaturized steel rims have been used with sponge basketballs. Such rims are generally inflexible and not well adapted for indoor use. Furthermore, the steel rims are not adapted to accept the force of a slam dunk. Instead, the force of the dunk is transferred to the rim and the supporting structure to which the backboard is secured. This can result in bending of the rim and damage to the support structure.

Although regulation size rims which retract upon the force of a dunk have been developed, such rims are difficult to miniaturize. Moreover, the cost of such miniaturized steel rims is prohibitive. Consequently, there is a need for a miniature indoor basketball backboard and retractable rim assembly that minimizes damage to the indoors of a house.

SUMMARY OF THE INVENTION

A miniaturized backboard and rim assembly for use with a sponge basketball is provided which has a generally rectangular basketball backboard. A steel basketball rim is secured to a base plate and the base plate is attached to the backboard by means of a hinge. In this manner, the rim is adapted to swing between a downward position parallel to the plane of the backboard and an upright position perpendicular to the plane of the backboard. A rim-retaining means is attached to the backboard and is adapted to maintain the rim in a perpendicular position relative to the backboard when no force is applied to the rim. When a downward force is applied to the rim, the rim-retaining means allows the rim to respond in a downward swinging motion.

Preferably the rim-retaining means is formed from a stop block which is attached to the backboard immediately above the base plate of the rim. Two hooks are provided on opposite sides of the stop block and a resilient member, such as a rubberband, is connected to the hooks and passes under the base plate of the rim. The tension force of the rubberband will maintain the rim in a perpendicular position relative to the backboard. To provide additional elastic force to the rubberband, a third hook may be provided on the underside of the stop block in a position such that it stretches out the rubberband to provide further tension.

In order to prevent damage to the supporting structure, the backboard and rim assembly is adapted to hang from a support. The hanging means includes eye-bolts secured in the upper portions of the backboard in either corner. An open link connector is used to attach the eye-bolt to an eye-screw provided in the supporting structure. In such a manner, the back board is free to hang from the support. Rubber pads can be provided on the bottom of the backboard to prevent the backboard from banging into the supporting structure.

The present backboard and rim assembly is adapted to use a steel rim which will duplicate the action of a standard outdoor basketball rim. The rim is adapted to collapse under the force of a dunk which will prevent the force from being transferred to the support structure inside the house.

DESCRIPTION OF THE PREFERRED EMBODIMENT

Figure 1:
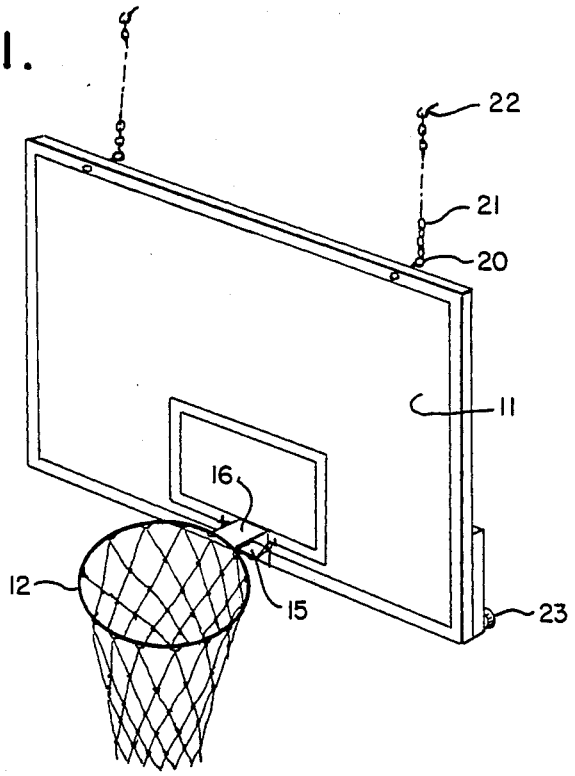
FIG. 1 is an isometric view of a present preferred backboard and rim assembly according to the present invention.

As shown in the drawings, my miniaturized backboard and rim assembly is formed from backboard 11 and rim 12. Preferably, backboard 11 is formed from a clear plexiglass. Rim 12 is preferably formed from steel to enable it to duplicate the action of a standard outdoor basketball rim.

Rim 12 is attached to backboard 11 by means of a hinge assembly 13. Hinge assembly 13 includes screw plate 14 and base member 15. Rim 12 is immediately attached to base member 15 and screw plate 14 is secured to backboard 11. Hinge assembly 13 is arranged such that rim 12 is free to swing from a downward position parallel to the plane of backboard 11 to an upright position perpendicular to the plane of backboard 11.

Figure 5:
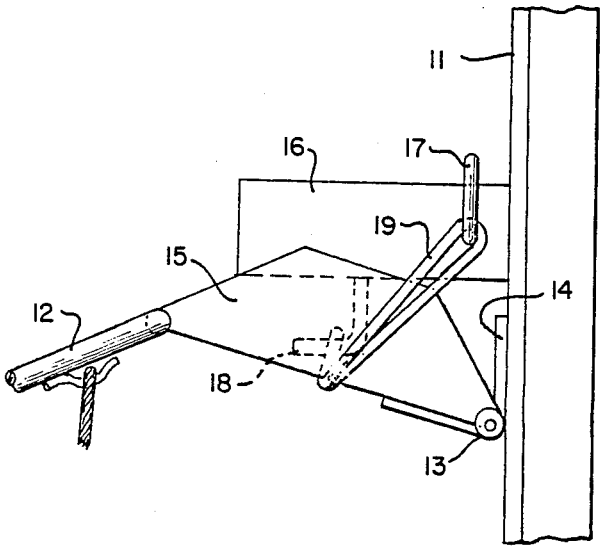
FIG. 5 is a side view of the rim assembly of FIG. 1 when a downward force is applied to the rim.
Figure 6:
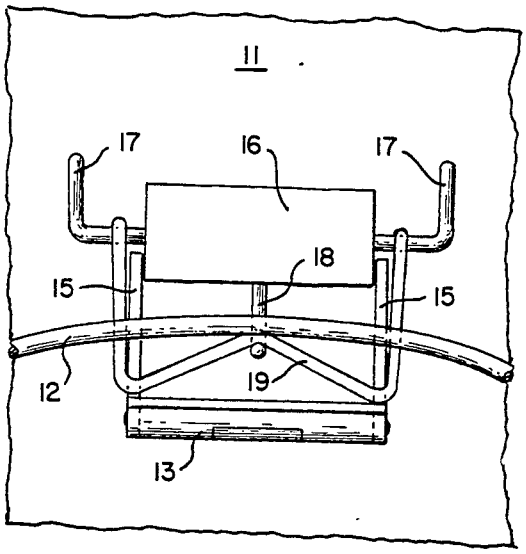
FIG. 6 is a top view of the rim assembly of FIG. 5.
Figure 2:
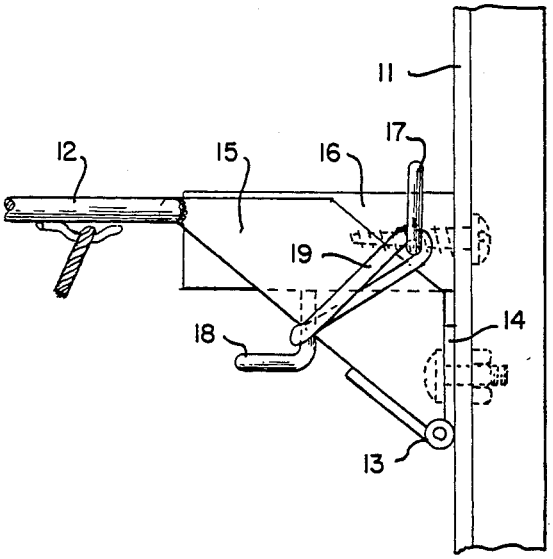
FIG. 2 is a side view of the rim assembly of FIG. 1 when no downward force is applied to the rim.
Figure 3:
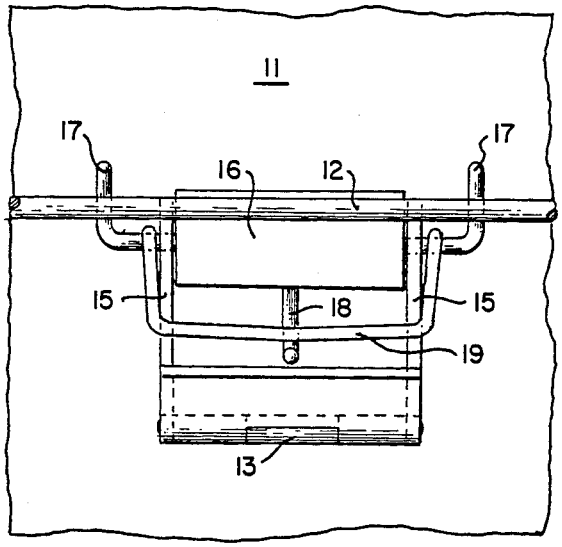
FIG. 3 is a front view of the rim assembly of FIG. 2.
Figure 4:
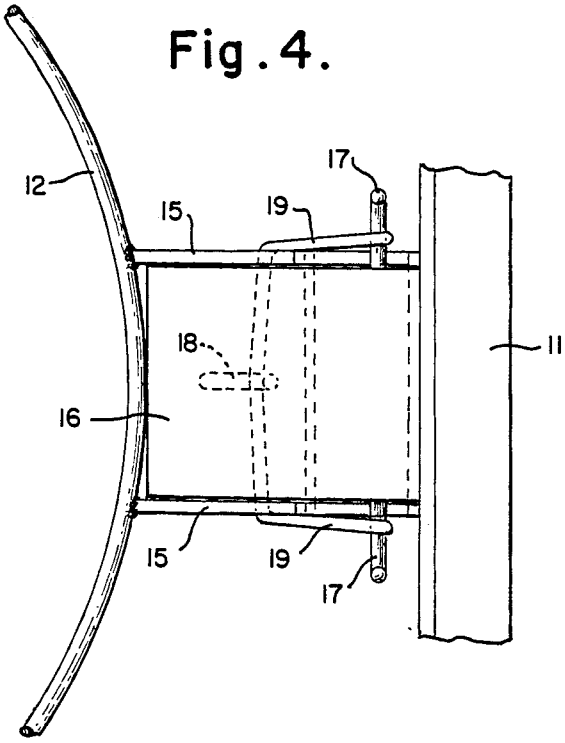
FIG. 4 is a top view of the rim assembly of FIG. 2.

A rim-retaining means is attached to the backboard and is adapted to maintain the rim in a perpendicular position relative to the backboard when no force is applied to the rim. Rim-retaining means includes stop block 16 which is attached to the backboard immediately above base member 15 of the rim. A pair of hooks 17 are provided on opposite sides of stop block 16. A resilient member, such as rubberband 19, is connected to hooks 17 and passes under base member 15. The tension in the rubberband will secure rim 12 in abutting engagement with stop block plate 16, thereby maintaining rim 12 in perpendicular relationship to backboard 11. A hook 18 is provided on the underside of stop block 16. Preferably, base member 15 has an opening provided therein through which hook 18 projects. Rubberband 19 is then looped around hook 18 to provide added tension to the rubberband 19. This third hook 18 also prevents the rubber band 19 from sliding onto the hinge assembly when the rim is retracted. As shown in FIGS. 5 and 6, when fully extended, rubberband 19 forms a W-shaped pattern in which four tensioned segments pull rim 12 into a perpendicular relationship to backboard 11.

The backboard 11 may be attached to a support structure such as a wall for indoor use. Eye bolts 20 are provided in the upper corners of backboard 11. Link chain 21 is connected to eye-bolt 20 and extends upward to a screw, nail or bolt 22 which is secured to a wall or other indoor support. In this manner, backboard 11 is free to hang from the support. Pads 23 may be provided on the bottom corners of backboard 11 to prevent backboard 11 from banging into an indoor wall.

My backboard and rim assembly functions as a standard rim and backboard. Because the rim 12 is formed of steel, the action of the ball on the rim is comparable to that in a regulation game. When a strong downward force is applied on rim 12, such as from a slam dunk, rubberband 19 stretches and permits hinge assembly 13 to collapse. Rim 12 will approach a parallel relationship with backboard 11. When the downward force is released, rim 12 recoils into its standard perpendicular relationship. Consequently, the force of the slam dunk will not bend the rim 12.

While I have described a certain presently preferred embodiment of my invention, it is to be distinctly understood that the invention is not limited thereto and may be otherwise variously practiced within the scope of the following claims.

I claim:

1. A backboard and rim assembly for use with a sponge basketball comprising:
   (a) a basketball backboard;
   (b) a base member pivotably attached to said backboard;
   (c) a basketball rim secured to said base member such that said rim may swing between a downward position parallel to the plane of said backboard to an upright position perpendicular to said plane of said backboard;
   (d) a stop block attached to said backboard immediately above said rim;
   (e) two hooks, one of each said hooks provided on each of opposite sides of said stop block; and
   (f) a resilient member connected to said hooks and passing under said base member of said rim to maintain said rim in a perpendicular position relative to said backboard when no force is applied to the rim and to allow said rim to respond to a downward force applied thereon.

2. The assembly of claim 1 also comprising a third hook provided on the underside of said stop block, said resilient member looping around said third hook.

3. The assembly of claim 1 wherein said resilient member is a rubberband.

4. The assembly of claim 1 further comprising hanging means to secure said backboard to a support.

5. The assembly of claim 4 wherein said hanging means comprises
   (a) at least one eye-bolt secured to a top corner of said backboard; and
   (b) a link chain connected to said eye-bolt.

6. The assembly of claim 5 further comprising cushion pads provided on the bottom corners of said backboard to prevent said backboard from damaging a supporting wall.

* * * * *